US007277151B2

(12) United States Patent
Ryu et al.

(10) Patent No.: US 7,277,151 B2
(45) Date of Patent: Oct. 2, 2007

(54) FLAT PANEL DISPLAY WITH PHOTOSENSITIVE GLASS SPACER

(75) Inventors: Kyung-Sun Ryu, Seoul (KR); Eung-Joon Chi, Seoul (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 10/160,696

(22) Filed: May 31, 2002

(65) Prior Publication Data

US 2003/0071553 A1 Apr. 17, 2003

(30) Foreign Application Priority Data

Oct. 15, 2001 (KR) ..... 2001-63449

(51) Int. Cl.
*H01J 1/88* (2006.01)
*H01J 19/42* (2006.01)

(52) U.S. Cl. ..... 349/155; 313/292; 313/495; 313/582

(58) Field of Classification Search ..... 349/155, 349/156, 157; 313/292, 495, 582, 610, 611, 313/609; 445/24
See application file for complete search history.

(56) References Cited

U.S. PATENT DOCUMENTS 5,347,292 A * 9/1994 Ge et al. ..... 345/75.2
5,548,181 A * 8/1996 Jones ..... 313/309
5,565,742 A * 10/1996 Shichao et al. ..... 315/366
5,703,611 A * 12/1997 Kishino et al. ..... 345/75.2
5,834,891 A * 11/1998 Novich ..... 313/495
5,894,193 A 4/1999 Amrine et al.
5,894,194 A * 4/1999 Lu et al. ..... 313/496
5,997,377 A * 12/1999 Sagara et al. ..... 445/24
6,144,153 A * 11/2000 Nakatani ..... 313/495
6,149,484 A 11/2000 Amrine et al.
6,285,127 B1 * 9/2001 Khan et al. ..... 313/582
6,501,526 B1 * 12/2002 Oh ..... 349/155

* cited by examiner

*Primary Examiner*—David Nelms
*Assistant Examiner*—Michael H. Caley
(74) *Attorney, Agent, or Firm*—Christie, Parker & Hale, LLP

(57) ABSTRACT

A flat panel display includes a vacuum container having a pair of flat panels disposed facing each other at a predetermined gap, and a spacer disposed between the panels to maintain the gap. The spacer includes plural sub-spacers bonded to each other at least one bonding portion.

8 Claims, 7 Drawing Sheets

FLAT PANEL DISPLAY WITH PHOTOSENSITIVE GLASS SPACER

CROSS-REFERENCE TO RELATED APPLICATIONS

This application claims priority to and the benefit of Korean Application No. 2001-63449, filed on Oct. 15, 2001 in the Korean Patent Office, the entire disclosure of which is incorporated herein by reference.

FILED OF THE INVENTION

The present invention relates to a flat panel display, and more particularly, to a flat panel display with a photosensitive glass spacer for maintaining a cell gap.

BACKGROUND OF THE INVENTION

Generally, a flat panel display (FPD) has an advantage of saving space as it can be designed to be thin and be driven by a relatively low voltage. Well known FPDs include: a field emission display (FED), a vacuum fluorescent display (VFD), a liquid crystal display (LCD), and a plasma display panel (PDP).

Such FPDs are generally formed of a vacuum container having a pair of facing panels and a spacer for maintaining a gap between the panels. When the panels are sealed in a high vacuum state, the panel may be deformed or damaged by the pressure difference between the inner and outer sides of the panels. The spacer prevents such deformation and damage to the panels. In addition, the spacer maintains the cell gap between the panels to uniformly realize the brightness when an image is displayed by exciting phosphors. The spacer is generally formed through screen-printing. That is, a screen mask having a predetermined pattern of mesh holes and a panel on which the spacer is to be formed are first fixed on a printing device. Paste is provided on the screen mask and squeezed onto the panel through the screen mask. However, screen-printing has a limitation in precisely forming the spacer and in increasing the aspect ratio (i.e., the height with respect to the width).

Accordingly, in recent years, a photosensitive glass spacer has been proposed to solve the above problems. U.S. Pat. Nos. 5,894,193 and 6,149,484 disclose a field emission display having such a photosensitive glass spacer and a method for manufacturing the same. As taught by these patents, a photosensitive glass having a predetermined thickness is crystallized in a predetermined pattern, and the crystallized pattern is removed to form a single spacer frame assembly. However, the spacer may deteriorate the quality of the flat display, due to the following reasons.

First, when the light exposure for crystallizing the photosensitive glass is not fully realized, the crystallization on the opposite surface, which is not directly exposed to the light, is realized less than at the light-exposing surface during the heat-treatment process for baking the spacer. This causes the aspect ratio of the completed spacer to be reduced. This will be described in more detail with reference to the accompanying drawings. As shown in FIG. 8*a*, photosensitive glass 100 having a predetermined thickness (i.e., 1.2 mm) is formed in a predetermined pattern through a light exposing process whereby ultraviolet rays (UV) are emitted onto one surface 102 of photosensitive glass 100. Then, glass 100 is heat-treated to form selective crystallized portion 104 on photosensitive glass 100. Crystallized portion 104 is removed through an etching process to form a single spacer. During this process, when the light exposure is not fully performed, an opposite surface 106 of light exposing surface 102 of the glass is not sufficiently exposed to the ultraviolet rays, and the crystallization is not sufficiently realized on opposite surface 106. Therefore, as shown in FIG. 8*b*, the width of the upper and lower portions of spacer 108 becomes different, resulting in the reduction of the aspect ratio. Accordingly, to solve the above problems, the light exposure is performed for a sufficient time. However, when the thickness of the photosensitive glass is doubled, the light exposure time must be increased six times. This is time-consuming and deteriorates productivity.

Secondly, the spacer is designed not to discriminate as to the upper and lower portions. This structure makes it difficult for the spacer to be easily arranged on the panels as the patterns of electrode and phosphor layers are differently formed on the facing panels. For example, a cathode panel is provided with plural stripe-type electrodes and an anode panel is provided with a dot-type phosphor layer. Therefore, it is difficult to effectively arrange the spacer on the non-display area of the panels.

Thirdly, while a rectangular frame-type or cross-type spacer can be easily arranged, however to obtain the effective function of the spacer, the number of spacers should be increased, making it difficult to arrange the spacers. A rib- or sheet-type spacer can be arranged in the longitudinal direction of the panel, reducing the number of spacers. However, a special member for stably supporting the spacers becomes required.

The present invention provides a solution to the above-described problems.

SUMMARY OF THE INVENTION

In accordance with the present invention a spacer for a flat panel display is provided that has a high aspect ratio and that can be easily arranged in response to various patterns of a variety of elements such as a cathode electrode and a phosphor layer that are formed on panels defining a vacuum container.

A flat panel display is accordingly provided which includes a vacuum container having a pair of flat panels disposed facing each other at a predetermined gap and a spacer disposed between the panels to maintain the gap, wherein the spacer includes plural sub-spacers bonded to each other at least one bonding portion. The spacer can be formed of a photosensitive glass. The bonding portion can be formed by a thermal diffusion bonding process. The sub-spacers can have different shapes from each other. One of the sub-spacers is formed as a cross-type pillar, in a rectangular pillar shape, or in a bar shape. The sub-spacers can be symmetrically formed on the basis of the bonding portion. The flat panel display further includes a cathode electrode formed on a surface of one of the panels. An emitter is formed on the surface of the cathode electrode. An anode electrode is formed on a surface of the other panel. A phosphor layer is formed on the surface of the anode electrode.

DETAILED DESCRIPTION OF THE PREFERRED EMBODIMENTS

An embodiment of the present invention and a variety of modified examples will now be described in more detail, in conjunction with the accompanying drawings.

Figure 1:
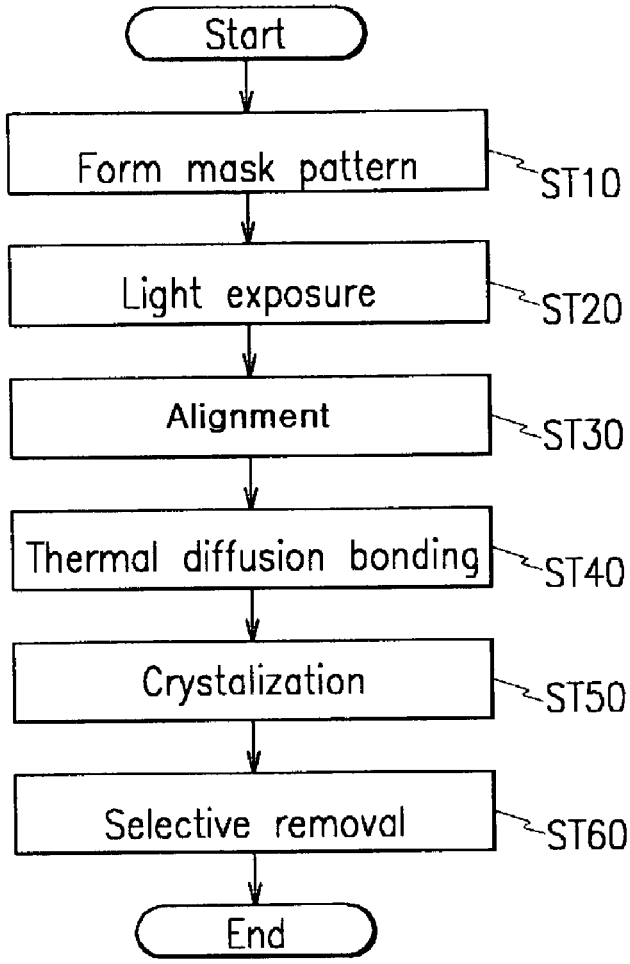
FIG. 1 is a block diagram illustrating the steps for manufacturing a spacer for a FPD according to a preferred embodiment of the present invention.

FIG. 1 shows the steps for manufacturing a spacer for a flat panel display in accordance with an embodiment of the present invention.

As shown in the drawing, a desired mask pattern is first formed on each of more than two photosensitive glasses (ST 10). The photosensitive glasses are exposed to an exposing lamp (ST 20). Then, after the mask pattern is removed, the photosensitive glasses are aligned/stacked in a multi-layer (ST30). Next, the stacked glasses are bonded to each other through a thermal diffusion process (ST40). The bonded glasses are crystallized through a baking process for making the light-exposed portion and the non-light-exposed portion different (ST50). Finally, a portion of the photosensitive glasses is selectively removed (ST 60).

Figure 2A:
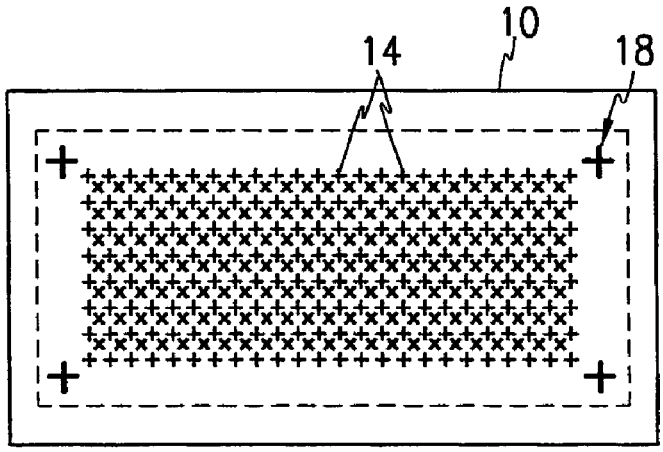
FIGS. 2*a* and 2*b* are plane views illustrating the pattern-forming step of a spacer according to a preferred embodiment of the present invention.
Figure 2B:
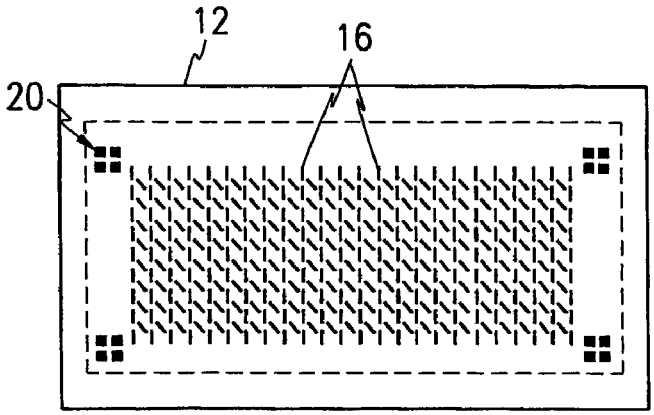

The above steps are described in more detail with reference to FIGS. 2*a,* 2*b,* 3, 4, and 5. As shown in FIGS. 2*a* and 2*b,* plural photosensitive glasses 10 and 12, each having a predetermined thickness, are prepared. Glasses 10 and 12 are formed of a composition having, for example, 75 wt % of $SiO_2$, 7 wt % of $LiO_2$, 3 wt % of $K_2O$, 3 wt % of $Al_2O_3$, 0.1 wt % of $Ag_2O$, and 0.02 wt % of $CeO_2$. However, the composition is not limited to this. Mask patterns 14 and 16 are respectively formed on photosensitive glasses 10 and 12 in a state where the photosensitive glasses 10 and 12 are arranged on a table. At this point, mask patterns 14 and 16 are formed of a chrome layer. For example, plural cross-type mask patterns 14 are formed on photosensitive glass 10 shown in FIG. 2*a,* and plural stripe-type mask patterns 16 are formed on photosensitive glass 12 shown in FIG. 2*b.* In addition, aligning marks 18 and 20 are formed on corners of glasses 10 and 12 at outer sides of mask patterns 14 and 16.

Figure 3:
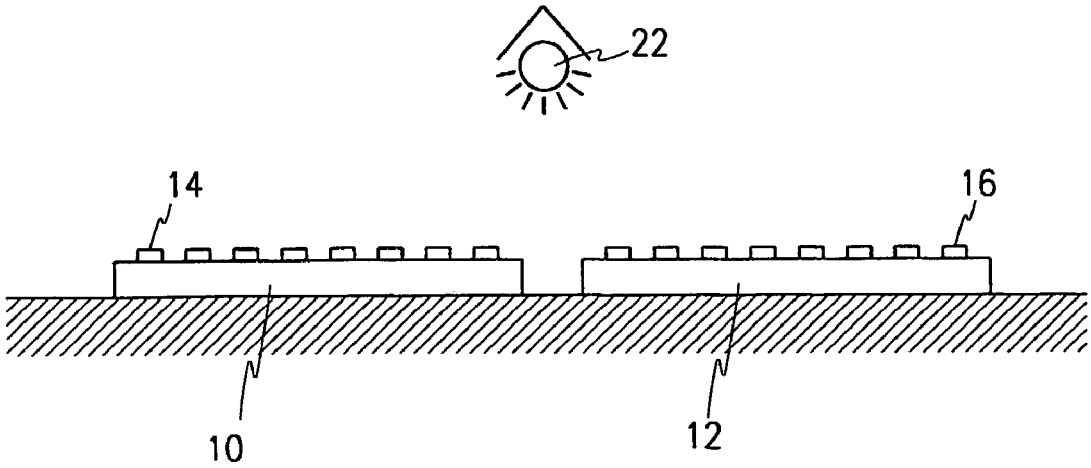
FIG. 3 is a side view illustrating the light-exposing step of the spacer according to a preferred embodiment of the present invention.
Figure 4:
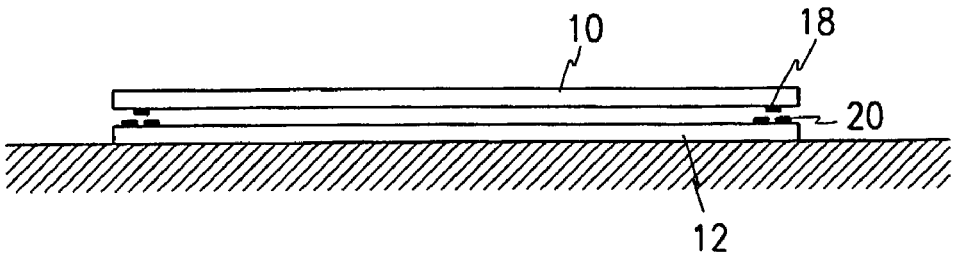
FIG. 4 is a side view illustrating the aligning step of a spacer according to a preferred embodiment of the present invention.

Referring now to FIG. 3, after forming mask patterns 14 and 16 and aligning marks 18 and 20, photosensitive glasses 10 and 12 are exposed to an exposing lamp. At this point, a mercury lamp or an ultraviolet lamp having waves within a range of 280~320 nm is used as exposing lamp 22. In this embodiment, the ultraviolet lamp is used as exposing lamp 22. The light exposing process is performed at room temperature. After the light exposing process, mask patterns 14 and 16 are removed from glasses 10 and 12, and as shown in FIG. 4, photosensitive glasses 10 and 12 are aligned using aligning marks 18 and 20. At this point, each of photosensitive glasses 10 and 12 are stacked such that the surfaces exposed to the light face each other.

Figure 5:
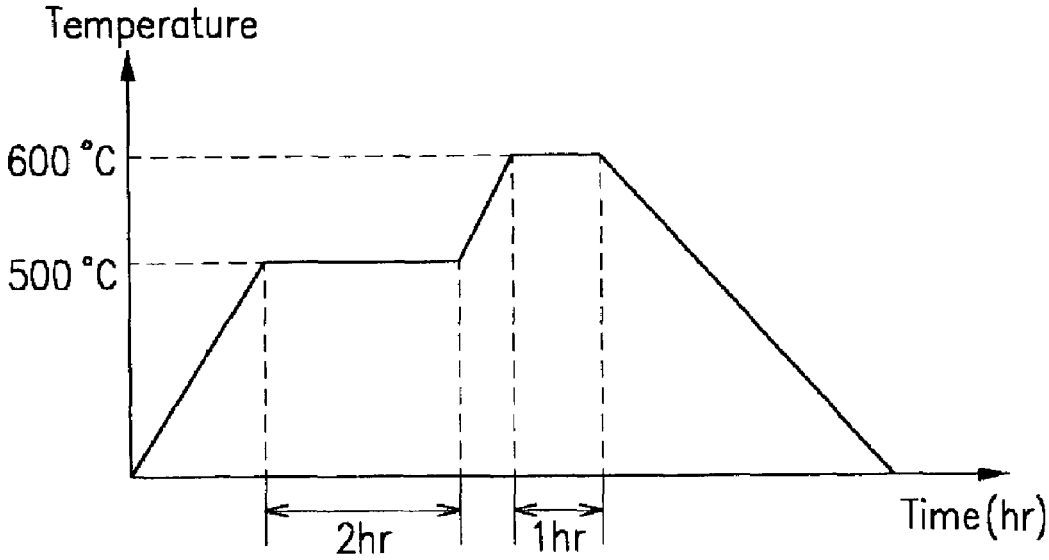
FIG. 5 is a graph illustrating a temperature profile of the thermal diffusion bonding step and the crystallization step according to a preferred embodiment of the present invention.

After the above alignment/stacking, the thermal diffusion bonding process and the crystallization process are performed according to the temperature profile shown in FIG. 5. That is, aligned glasses 10 and 12 are disposed in a heat-treatment apparatus and the temperature of the heat-treatment apparatus is increased to 500° C. and maintained for 2 hours, during which glasses 10 and 12 are bonded to a strength of 200 g/cm$^2$. The temperature of the heat-treatment apparatus is then increased to 600° C. and maintained for one hour, during which time glasses 10 and 12 are baked to facilitate crystallization.

When crystallization step ST50 is completed, and the exposed portion of photosensitive glasses 10 and 12 are crystallized, the crystallized portion is etched with an HF solution.

Figure 6A:
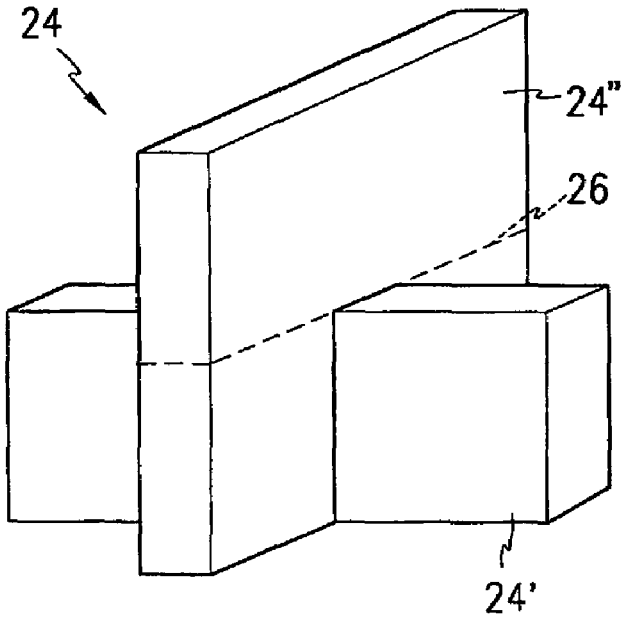
FIGS. 6*a,* 6*b,* 6*c,* 6*d,* 6*e,* and 6*f* are views of a variety of spacers according to modified examples of the present invention.

Referring now to FIGS. 6*a,* 6*b,* 6*c,* 6*d,* 6*e,* and 6*f* a variety of modified examples of spacer 24 according to the present invention are shown.

Figure 6B:
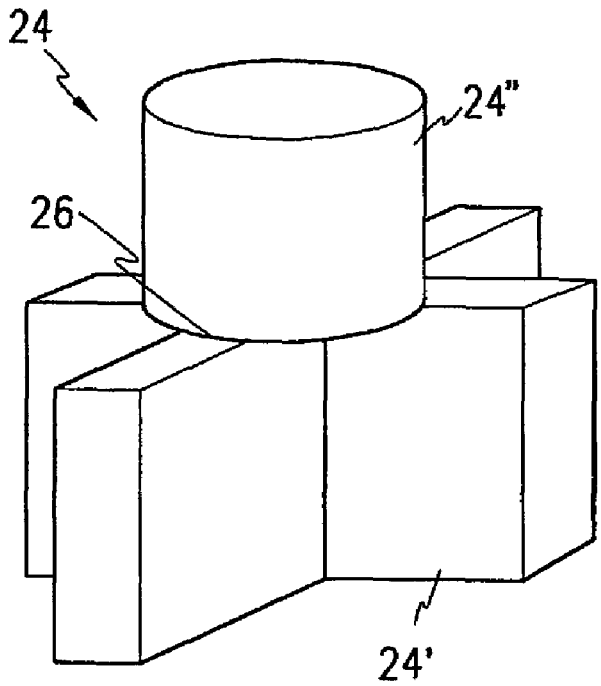
Figure 6C:
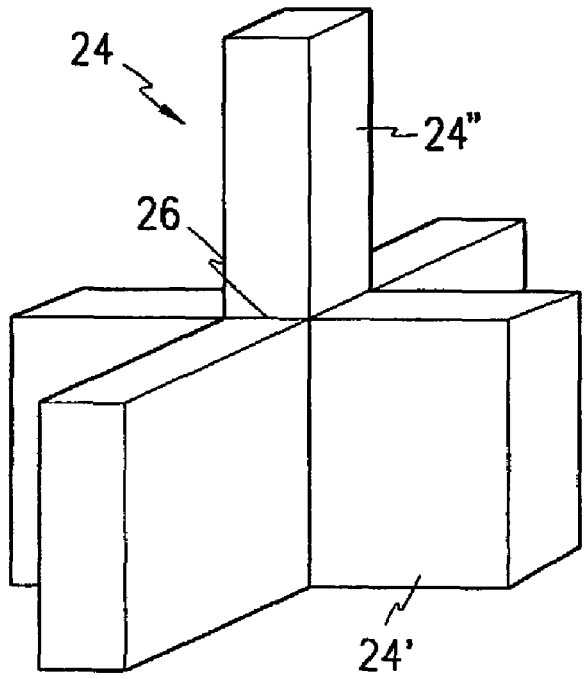
Figure 6D:
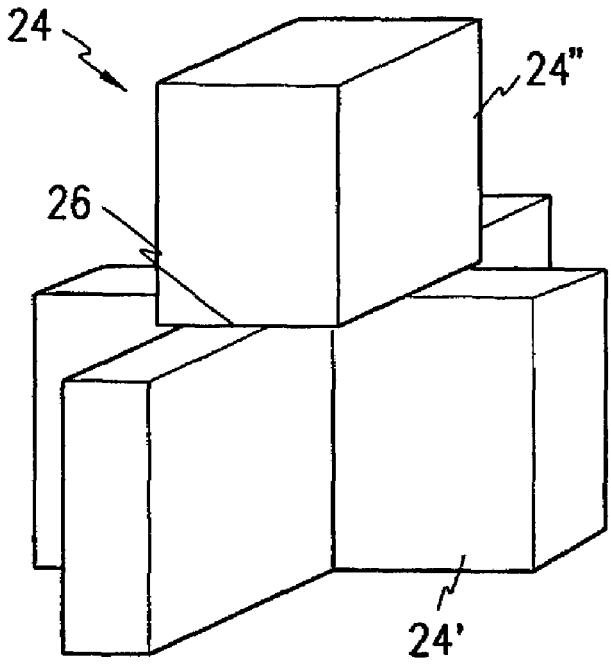

Lower sub-spacer 24' can be formed as a cross-shape pillar; and an upper sub-spacer 24" can be formed: in a rectangular bar shape arranged in an opposite direction to one of the cross-shape arms of lower sub-spacer 24' (see FIG. 6*a*), in a cylindrical shape arranged on outer and inner portions of the upper surface of lower sub-spacer 24' (see FIG. 6*b*), in a rectangular pillar shape disposed on a center portion of the upper surface of lower sub-spacer 24' (see FIG. 6*c*), or a cube shape disposed on outer and inner portions of the upper surface of lower sub-spacer 24' (see FIG. 6*d*).

The reference numeral 26 in the drawings indicates a bonding portion formed through the thermal diffusion bonding process. Bonding portion 26 is formed at more than one location of spacer 24. For example, when spacer 24 is formed of upper and lower sub-spacers 24' and 24", the bonding portion is provided at one location of spacer 24. When spacer 24 is formed of more than three sub-spacers, bonding portion 26 is formed at two locations of spacer 24.

Figure 6E:
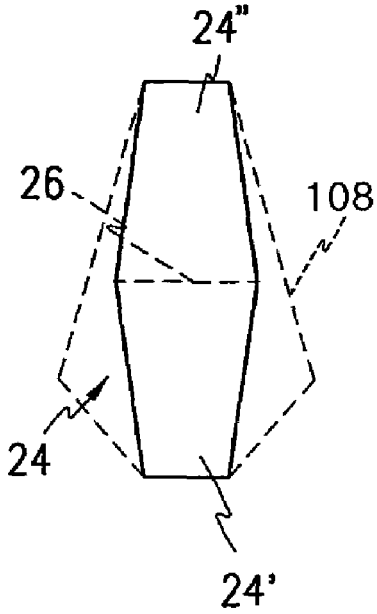

In addition, spacer 24 shown in FIG. 6*e* has symmetrically disposed upper and lower sub-spacers 24' and 24" disposed symmetrically on the basis of bonding portion 26. As shown in the drawing, the aspect ratio of the spacer of this embodiment is increased when compared with conventional single spacer 108 shown as a broken line. When spacer 24 of the present invention is designed having a height identical to conventional spacer 108, since each height of lower and upper sub-spacers 24' and 24" is half of the conventional one, the light exposing can be more effectively realized. That is, the light exposing is effectively realized on both surfaces of each of lower and upper spacers 24' and 24".

Figure 6F:
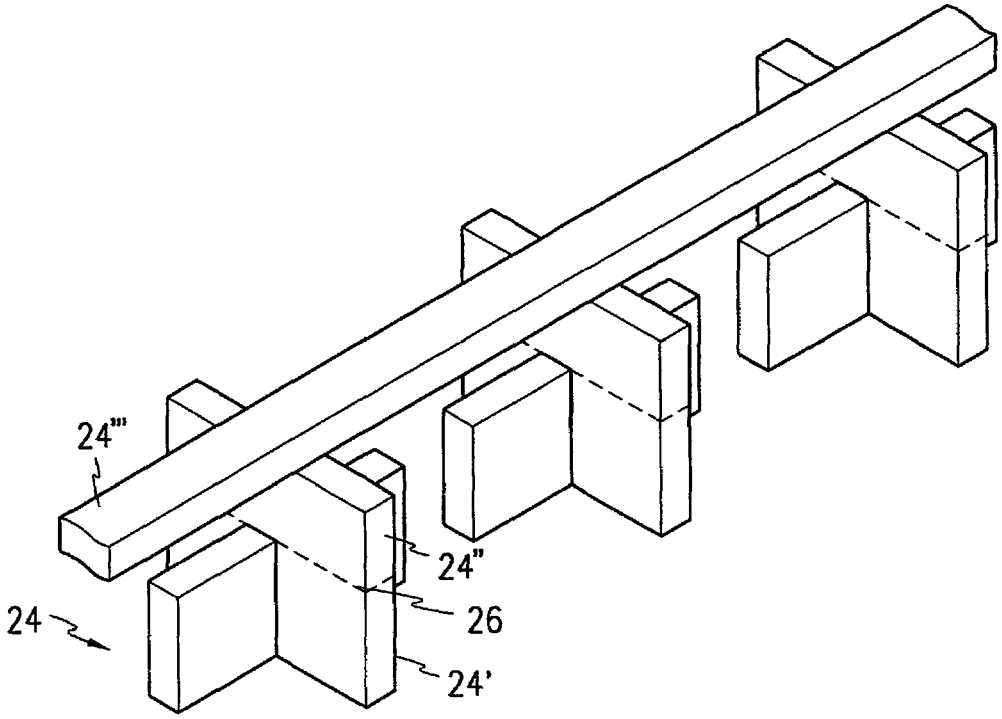

In FIG. 6*f,* lower sub-spacer 24' is formed in a cross shape, and upper sub-spacer 24" is formed in a stripe shape. A third sub-spacer 24'" formed in a bar shape is disposed on upper sub-spacer 24". Third spacer 24'" is bonded on upper sub-spacer 24" through the thermal diffusion bonding process. That is, spacer 24 shown in FIG. 6*f* is formed in a three-level structure having lower and upper sub-spacers 24' and 24" and third sub-spacer 24'". The spacer 24 is applicable to any flat panel display, such as a field emission display.

Figure 7:
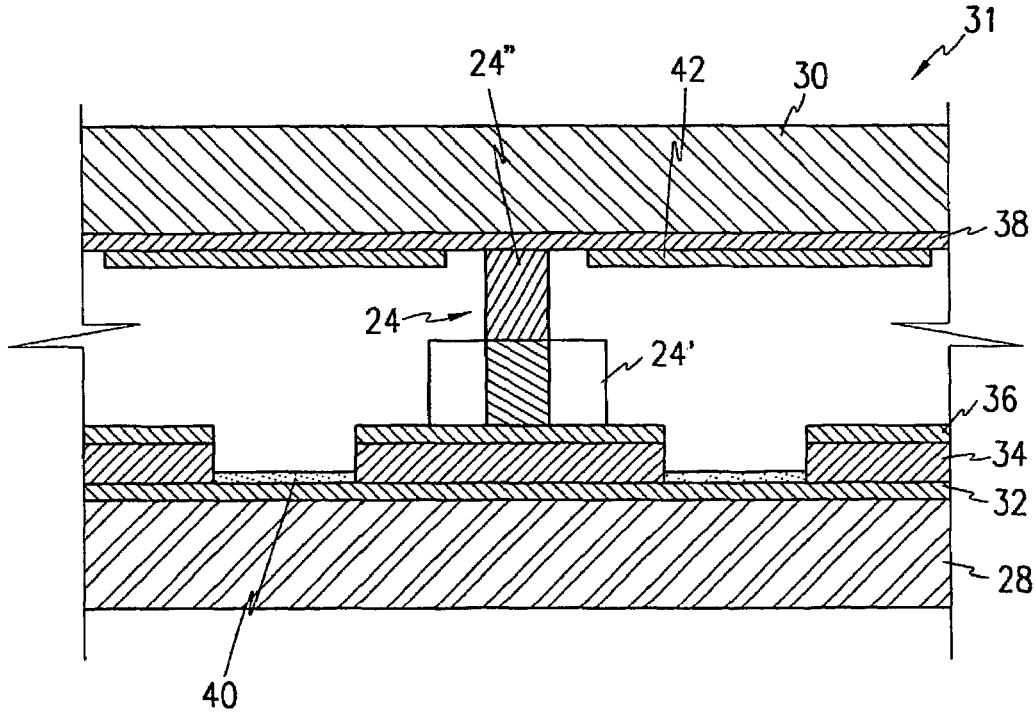
FIG. 7 is a sectional view of a flat display panel according to a preferred embodiment of the present invention.
Figure 8A:
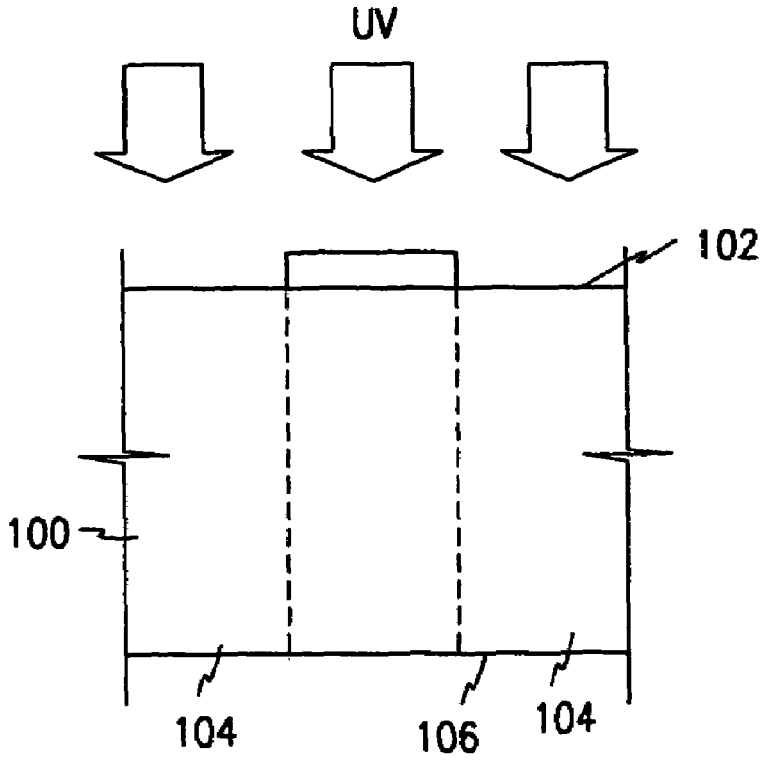
FIG. 8a (PRIOR ART)
FIGS. 8*a* and 8*b* are views illustrating the steps for manufacturing a conventional spacer of a flat panel display.
Figure 8B:
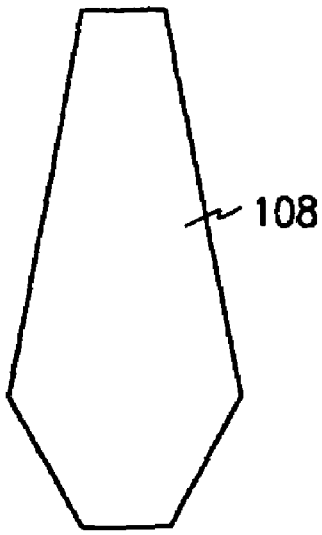
FIG. 8b (PRIOR ART)

FIG. 7 is a partial sectional view of a field emission display, which is a flat panel display, according to a an embodiment of the present invention. That is, the field emission display includes a vacuum container 31 formed of a pair of panels 28 and 30.

Cathode electrodes 32 formed in plural line patterns are formed on an inner surface of cathode panel 28. Gate electrodes 36 formed in plural line patterns at right angles to the line patterns of cathode electrode 32 are formed on an insulating layer 34 formed on the inner surface of cathode panel 28 to cover cathode electrodes 32.

Anode electrodes 38 formed in plural line patterns arranged in an identical direction to the line patterns of cathode electrodes 32 are formed on anode panel 30.

Plural holes are formed on pixel regions where the line patterns of cathode electrodes 32 intersect the line patterns of gate electrodes 36. Planar emitter 40 formed of carbon-based material such as carbon nanotubes is formed on cathode electrodes 32 through the holes.

Here, an electron-emission material such as molybdenum can be used instead of planar emitter 40.

On a surface of each anode electrode 38, opposing emitter 40, patterns of phosphor layer 42 excited by the electrons emitted from emitter 40 are formed. One end of each spacer 24 for supporting anode electrode 38 is formed on anode electrode 38 between the patterns of phosphor layer 42. The other end of the spacer is supported on gate electrode 36.

Here, lower sub-spacer 24' of spacer 24 is formed in a cross shape, and upper sub-spacer 24" is formed in a stripe shape (see FIG. 6*a*).

The spacer 24 can be modified to the above-described modified examples according to the patterns of phosphor layer 42 and cathode electrode 32.

In the above described flat panel display, since the spacer is formed in a multi-layer having upper and lower sub-spacers, the aspect ratio thereof can be increased, thereby improving the quality of the display. Furthermore, since the upper and lower sub-spacers can be variably designed according to the pattern of the electrode and the phosphors, it is easy to set the location of the spacer.

Particularly, in a flat panel display having a cathode panel provided with a stripe pattern electrode and an anode panel provided with a dot pattern phosphor, it is possible to effectively locate the spacer on the non-display area.

Furthermore, since plural spacers are bonded by bar-type sub-spacers, the manufacturing process can be simplified.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A flat panel display comprising:

a vacuum container having a pair of flat panels disposed facing each other at a predetermined gap, the pair of flat panels including a first panel and a second panel, the first panel having patterns of phosphor layer formed; and a spacer disposed between the pair of panels to maintain the gap, wherein the spacer includes plural sub-spacers bonded to each other at a bonding portion, wherein the spacer is formed of a photosensitive glass, wherein one end of the spacer is disposed between the patterns of phosphor layer, wherein a first group of sub-spacers are formed on the first panel and a second group of sub-spacers are formed on the second panel, wherein the first group of sub-spacers has a different shape compared with the second group of sub-spacers, and wherein a surface area of the first group of sub-spacers at the first panel is smaller than a surface area of the second group of sub-spacers at the second panel.

2. The flat panel display of claim 1, wherein one of the sub-spacers is formed as a cross-type pillar.

3. The flat panel display of claim 1, wherein one of the sub-spacer is formed in a bar shape.

4. The flat panel display of claim 1, wherein one of the sub-spacer is formed in a cylinder shape.

5. The flat panel display of claim 1, wherein one of the sub-spacers is formed in a pillar shape.

6. The flat panel display of claim 1, wherein one of the sub-spacer is formed in a cube shape.

7. The flat panel display of claim 1, wherein the sub-spacers are symmetrically formed on the basis of the bonding portion.

8. The flat panel display of claim 1, further comprising:

a cathode electrode formed on a surface of one of the panels;

an emitter formed on the surface of the cathode electrode;

an anode electrode formed on a surface of the other panel; and the patterns of phosphor layer formed on the surface of the anode electrode.

* * * * *

UNITED STATES PATENT AND TRADEMARK OFFICE

CERTIFICATE OF CORRECTION

PATENT NO. : 7,277,151 B2
APPLICATION NO. : 10/160696
DATED : October 2, 2007
INVENTOR(S) : Kyung-Sun Ryu et al.

It is certified that error appears in the above-identified patent and that said Letters Patent is hereby corrected as shown below:

On the Title Page

| | |
|---|---|
| (57) Abstract, line 5 | After "other",<br>Insert --at the point of-- |

In the Claims

| | |
|---|---|
| Column 6, line 27, Claim 3 | Delete "sub-spacer",<br>Insert --sub-spacers-- |
| Column 6, line 29, Claim 4 | Delete "sub-spacer",<br>Insert --sub-spacers-- |
| Column 6, line 33 | Delete "sub-spacer",<br>Insert --sub-spacers-- |

Signed and Sealed this

Twenty-sixth Day of August, 2008

JON W. DUDAS
*Director of the United States Patent and Trademark Office*